United States Patent [19]

Miyasaka et al.

[11] Patent Number: 4,966,748

[45] Date of Patent: Oct. 30, 1990

[54] METHODS OF PRODUCING CLAD METALS

[75] Inventors: Akihiro Miyasaka; Hiroyuki Ogawa, both of Sagamihara, Japan

[73] Assignee: Nippon Steel Corporation, Tokyo, Japan

[21] Appl. No.: 490,704

[22] Filed: Mar. 7, 1990

[30] Foreign Application Priority Data

Mar. 24, 1989 [JP] Japan ..... 1-70338

[51] Int. Cl.[5] ..... B22F 7/00

[52] U.S. Cl. ..... 419/8; 419/28; 419/29; 419/49; 427/350; 427/376.8

[58] Field of Search ..... 419/8, 49, 28, 29; 427/350, 376.8

[56] References Cited

U.S. PATENT DOCUMENTS

| | | | |
|---|---|---|---|
| 4,259,413 | 3/1981 | Taglang et al. | 419/8 |
| 4,627,958 | 12/1986 | Hays | 419/8 |
| 4,657,822 | 4/1987 | Goldstein | 419/8 |
| 4,844,863 | 7/1989 | Miyasaka | 419/8 |

FOREIGN PATENT DOCUMENTS

| | | |
|---|---|---|
| 61-190007 | 8/1986 | Japan . |
| 61-190008 | 8/1986 | Japan . |
| 61-223106 | 10/1986 | Japan . |
| 64-202 | 1/1989 | Japan . |

*Primary Examiner*—Stephen J. Lechert, Jr.
*Attorney, Agent, or Firm*—Wenderoth, Lind & Ponack

[57] ABSTRACT

A clad metal is produced by forming a layer of a dissimilar metal powder on the surface of a base metal by cold fixing the powder to the surface under pressure, densing only the surface and a subsurface area of the layer of the dissimilar metal powder by melting and immediately solidifying in a vacuum, compressing the layer of the dissimilar metal powder together with the base metal at a temperature not higher than the solidus-line temperature of the two dissimilar metals under a pressure of not lower than 300 kgf/cm$^2$ (or 29.4 MPa) using a hot isostatic press, and hot working the layer of the dissimilar metal powder together with the base metal.

9 Claims, 1 Drawing Sheet

METHODS OF PRODUCING CLAD METALS

BACKGROUND OF THE INVENTION

1. Field of the Invention

This invention relates to methods of producing clad metals and more particularly to methods of covering the surface of metals with dissimilar materials having desired properties such as good resistance to corrosion, high-temperature corrosion, oxidation and wear.

2. Description of the Prior Art

With the recent development in industries and technologies, many materials have come to be used in increasingly severe environments. For example, oil and natural gas produced today contain much hydrogen sulfide and carbon dioxide (such oil and gas are known as sour oil and sour gas). As low-alloy steels corrode an crack when exposed to sour oil and gas, such nickel-base alloys as Hastelloy C-276 and Inconel 625 have been used for oil-well and line pipes. (Hastelloy and Inconel are the trade names for groups of nickel-base corrosion-resistant alloys.) Because they are very expensive, clad metals covered with thin layers of such expensive alloys have come into use too, with the base metal (such as low-alloy steel) providing the strength required by individual applications.

Various processes for making seamless and welded cald-steel pipes and rolling clad-steel plates have been established and proposed. But all conventional processes are complex and low in yield. Clad steels with such nickel-base alloys as Hastelloy C-276 and Inconel 625, especially in tubular form, are so difficult to make that none has been put into commercial use. The inventors found that the alloys are much more resistant to the deformation induced by hot working than the base metal of low-alloy or carbon steel. Thus, the cladding alloy and base metal cannot be formed evenly by hot rolling or other ordinary processes. Dissimilar metals deforming independently defy the joining of pipes or other structural members.

Stellite (the tradename for a series of cobalt-base alloys) and other similar alloys are either overlaid or sprayed on to valve spindles, pistons and cylinders of reciprocating pumps and other sliding members and slurry transportation pipe requiring wear resistance. Ni-Cr, Ni-Cr-Al-Y, Co-Cr-Al-Y and other oxidation-resistant alloys are either overlaid or sprayed onto pressure vessels and steel pipes used in high-temperature environments. But overlaying or spraying dissimilar metals onto finished products extremely pushes up their production costs. Furthermore, it is impossible to apply them to such small spaces as the inside of small-diameter pipes.

Hot isostatic pressing is a well-known technology. Several clad metals utilizing this cladding technology have been proposed. For example, Japanese Provisional Patent Publication No. 223106 of 1986 discloses an efficient process for making high-alloy clad metals in which a powder of high-alloy metal is heated to above the solidus-line temperature thereof under pressure. But all of the conventionally reported or proposed hot isostatic pressing processes are costly because they are applied to finished products. Besides, they are not applicable to large or long (over 12 m in length, for example) products.

Japanese Provisional Patent Publications Nos. 190007 and 190008 of 1986 disclose two methods. In one of them a powder material is packed and sealed in a capsule composed of a malleable metal cylinder with a heavier wall thickness and a metal cylinder with a lighter wall thickness. The powder is the compressed into a billet by cold isostatic pressing. The obtained billet is hot extruded into a desired shape. In the other method, a cylindrical piece of a malleable metal is placed in a concentrically double-walled cylindrical container of rubber or other similar substance, whit the malleable metal held in contact with the inner wall of the container. A powder material is then packed and sealed between the outer wall of the container and the cylindrical malleable metal and compressed by cold isostatic pressing. The obtained billet is hot extruded into a desired shape. But neither of them solves the problems of the separation from the base metal and the cracking of the cladding layer subjected to hot extrusion of materials clad with such nickel-base alloys as Hastelloy C-276 and Inconel 625 and other similar materials highly resistant to hot working and inadequately adherent to the base metal.

In Japanese Patent Application No. 40644 of 1988 (or U.S. Pat. No. 4,844,863), the inventors proposed a method of cladding the surface or metal with a dissimilar metal by hot isostatic pressing in which a powder of the dissimilar metal is heated to a temperature not higher than the solidus-line temperature thereof under a pressure and shaping the obtained clad piece by hot working, a method of shaping the obtained clap piece by hot working after applying a solution treatment, and a method of shaping the obtained clad piece by hot working immediately after applying a soaking treatment.

SUMMARY OF THE INVENTION

The object of this invention is to provide methods of producing clad metals composed of a base metal and a dissimilar overlying metal with good resistance to corrosion, high-temperature corrosion, oxidation, wear and other hostile environment at lower cost and with greater ease than before.

The methods according to this invention comprise, in essence, the steps of forming layer of a powder of a dissimilar metal on the surface of a base metal by fixing the powder thereto without heat, densing only the surface and a subsurface area of the powder layer by melting and immediately solidifying in a vacuum, forming the powder layer into an overlying metal layer under a pressure of 300 kgf/cm$^2$ (or 29.4 MPa) or above at a temperature not higher than the solidus-line temperature of the dissimilar metals applied by a hot isostatic pressing and then hot working the piece into a desired shape. The methods of this invention also permit various variations. The porosity of the dissimilar metal powder layer may be reduced to 30 percent or under without heat. The layer of the dissimilar metal powder may be formed on the surface of the base metal using a cold press or cold isostatic press. The melting and solidification immediately thereafter of the surface and a subsurface area of the powder layer may be effected in a vacuum with a pressure of $1\times10^{-3}$ torr (or 0.133 Pa) or under. The melting and solidification immediately thereafter of the surface and a subsurface area of the powder layer may be performed using electron-beam, high-power laser or plasma melting. The surface and a subsurface area of the powder layer may be melted to a depth of not less than 0.3 mm and not more than 5 mm.

Capable of producing clad metals of excellent properties at lower cost and with greater ease than before, the methods of this invention add valuable contribution to the development of industries.

DESCRIPTION OF THE PREFERRED EMBODIMENTS

After conducting many experiments and studies, the inventors found a method of forming a coating layer by first forming and fixing a powder of a dissimilar metal of the surface of a base metal without heat, melting and solidifying only the surface and a subsurface area of the layer of a dissimilar metal powder in a vacuum, and subjecting the material to hot isostatic pressing. The method obviates the necessity of sealable containers for hot isostatic pressing. This dispenses with the processes to make, assemble, seal and remove, after hot isostatic pressing, sealable containers. Bonded firmly to the base metal, the overlying metal thus formed proved to have adequate hot workability. This method permits making clad metals at lower cost and with greater speed and ease than before.

The inventors also found that electron-beam, high-power laser and plasma melting are suited for melting only the surface and a subsurface area of the layer of a dissimilar metal powder.

The inventors further found that cold pressing and cold isostatic pressing are suited for fixing the powder of a dissimilar metal to the surface of a base metal without applying heat. It was also found that reducing the porosity of the layer of a dissimilar metal powder on the surface of a base metal to 30 percent or under increases the efficiency of subsequent hot isostatic pressing. Also it was found that solidifying only the surface and a subsurface area of the layer of a dissimilar metal powder immediately after melting in a atmosphere whose pressure is kept at $1\times10^{-3}$ torr (or 0.1333 Pa) or under increases the hot workability of the overlying layer after hot isostatic pressing.

This invention was made on the basis of the findings just described.

In the methods according to this invention, a powder of a dissimilar metal is fixed without heat to the surface of a base metal. Any kind or type of base metal and dissimilar metal can be fixed together. For instance, carbon, low alloy and stainless steels, nickel and nickel-base alloys, cobalt and cobalt-base alloys, titanium and titanium-base alloys can be used as the base metal. The overlying metal can be chosen from among, for example, Hastelloy, Stellite, nickel-chromium alloys, stainless steels, iron-base superalloys, nickel and nickel-base alloys, cobalt and cobalt-base alloys, titanium and titanium-base alloys.

Figure 1:
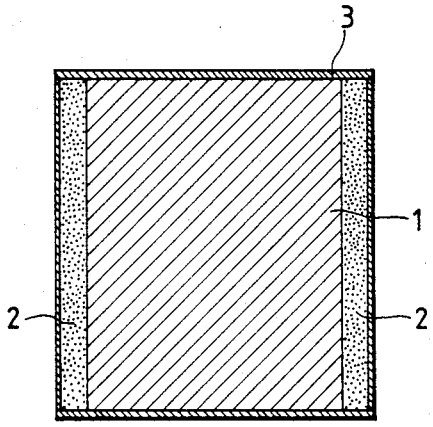
FIG. 1 is a cross-sectional view showing how a powder of a dissimilar metal is packed in a cold preforming process to bond the powder to the surface of a base metal.

To fix a layer of a powder of a dissimilar metal to the surface of a base metal, the base metal 1 and the powder of the dissimilar metal 2 are packed in a container 3 as shown in FIG. 1. Then, the powder of the dissimilar metal is compacted and preformed by applying pressure from outside the container without heating. Though the pressure inside the container needs not be lower than atmospheric, this process can be performed in a vacuum, too. Cold fixing is achieved by cold pressing or cold isostatic pressing. The container must be sealed when cold bonding is performed by cold isostatic pressing. The term "cold" used in this invention means that a process is carried out a temperature not higher than the recrystallization temperature of the base metal and the dissimilar overlying metal. The container material is not required to have very high rigidity. Rigidity high enough to assure satisfactory packing and fixing of the metal powder suffices.

Figure 2:
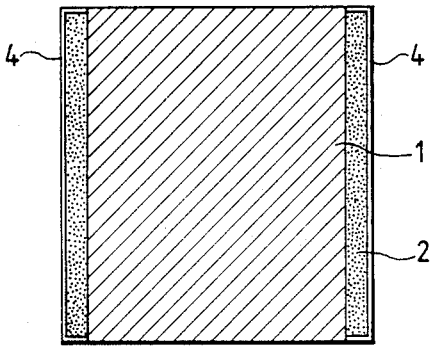
FIG. 2 is a cross-sectional view showing the relative position of the surface and a subsurface area of a layer of a dissimilar metal powder that is to be melted and solidified in a vacuum.

Next, only a portion 4 at and close to the surface of the layer of a dissimilar metal powder is melted and immediately solidified as shown in FIG. 2. This step assures effective application of isostatic pressure on the layer of a dissimilar metal powder is subsequent hot isostatic pressing. The reason why only a limited portion of the powder layer is melted is to prevent the coarsening of the solidification structure that might result from a more extensive melting. Coarsening of the solidification structure leads to the segregation of component elements which, in turn, hampers hot working. Only the surface and a subsurface area should be melted and solidified to acquire the compactness required for hot isostatic pressing. If the depth of melting is under 0.3 mm, the resulting compacted area may not be strong enough to withstand the deformation induced by hot isostatic pressing. When the weak compacted area breaks, isostatic pressure will not effectively work on the layer of a dissimilar metal powder. On the other hand, the effect of the compacted layer will show no further improvement even if the depth of melting is increased beyond 5 mm. Furthermore, deeper melting impairs hot workability as mentioned previously. Shallower melting is preferable from the viewpoint of subsequent hot working. The exposed surface of the layer of a dissimilar metal powder must be melted and immediately solidified throughout. Otherwise, satisfactory hot isostatic pressing and, therefore, satisfactory cladding of the dissimilar metal will not result.

To prevent the coarsening of the solidified structure and minimize the segregation of component elements, it is preferable to solidify quickly. Quick solidification can be achieved by use of, for example, electron-beam, hihg-power laser or plasma melting. Carbon dioxide gas laser and YAG laser are examples of the high-powder laser. A laser may be installed outside the vacuum system. A laser beam emitted therefrom can be irradiated on the surface of the layer of a dissimilar metal powder through a laser beam window provided in the vacuum container. Plasma melting can be achieved by use of ordinary transferred arc or un-transferred arc plasma.

The overlying metal layer must have good enough hot workability to assure satisfactory results in the subsequent hot working process. For this purpose, it is preferably to perform the melting and solidification in as high a vaccum as possible or, in other words, under as low a pressure as possible. Hot isostatic pressing forms as overlying metal layer with good hot workability in an atmosphere when the above melting and solidification are conducted at a pressure not higher than $1\times10^{-3}$ torr (or 0.1333 Pa).

When the cold-bonded layer of a dissimilar metal powder has a higher relative density, more effective hot isostatic pressing is possible. Efficient hot isostatic pressing is attainable with a porosity of 30 percent or under. Such hot isostatic pressing assures an overlying metal layer with good hot workability, too.

To impart good hot workability to the overlying metal layer, it is essential to perform hot isostatic pressing under sufficiently high temperature and pressure over a sufficiently long time.

Though varying with the type of the base metal and the overlying dissimilar metal, the hot isostatic pressing temperature must be lower than the solidus-line temperature of the two metals to maintain good hot workability. If the hot isostatic pressing temperature is higher than the solidus-line temperature, component elements will segregate when the obtained material cools down, significantly impairing the hot workability required in the next process. To shorten the hot isostatic pressing time, the highest possible temperature within the above-specified limit should be used. Increasing the hot isostatic pressing pressure will permit decreasing the hot isostatic pressing time and temperature. Under a pressure below 300 kgf/cm$^2$ (or 29.4 MPa), however, the layer of a dissimilar metal powder will not be bonded firmly enough to assure good hot workability, whatever hot isostatic pressing temperature and time may be chosen. To obtain good hot workability, therefore, the hot isostatic pressing pressure should not be lower than 300 kgf/cm$^2$ (or 29.4 MPa).

In the methods according to this invention, hot working is performed after the formation of the overlying metal layer. Clad metals produced under the aforementioned conditions can be hot worked like ordinary semi-finished products. The object of hot working in this invention is to produce lengthy or intricately shaped bimetal products by rolling or otherwise processing semi-finished products prepared as described before. Hot rolling, hot forging, hot extrusion or other proper process must be chosen depending on the shape of products to be made.

In this invention, hot working means working within the temperature ranges in which the base and overlying metals are normally worked into desired shapes. The hot working temperature to be chosen must be appropriate for both of the base and overlying metals.

When the product produced by the methods of this invention is a sheet or pipe, cladding may be given either on one side thereof, such as, for example, the top side of the sheet and the internal or external side of the pipe, or on both sides thereof, such as the top and bottom sides of the sheet and the internal and external sides of the pipe. Whether cladding is to be given on one side or both sides should be chosen according to the service requirements of individual products.

Various types of other processing to provide the required strength, toughness, corrosion resistance and other properties can be applied after hot working, too. Such additional processes include quenching, tempering and normalizing to control the strength and toughness of the base metal, solution heat treatment and annealing to further improve the corrosion resistance of the overlying metal and cold working to refine the shape of hot-worked products.

The methods of this invention can be used in the making of products that are required to have high resistance to the action of corrosive substances, oxidation at high temperatures and wear. Products of various shapes, such as pipes, vessels, sheets and bars, are manufacturable. Such products can be used as semi-finished products for forming, welding and other processes, too.

Now several examples of products made by the methods of this invention will be described in the following.

Figure 3:
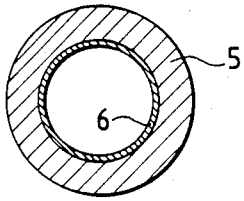
FIGS. 3 to 7 are cross-sectional views showing clad metals made by the methods according to this invention, with FIGS. 3 and 4 showing hollow billet, FIGS. 5 and 6 slabs, and FIG. 7 a solid billet.
Figure 4:
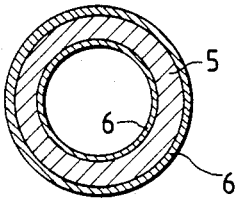
Figure 5:
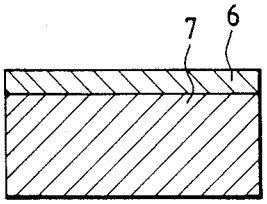
Figure 6:
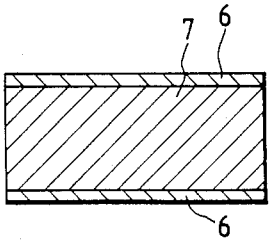
Figure 7:
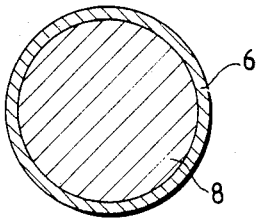

Semi-finished products for hot working were made using the materials and manufacturing conditions shown in Table 1. Examples Nos. 1 to 3 are hollow billets with an overlying layer formed on the internal side thereof. Examples Nos. 4 to 6 are hollow billets with an overlying layer formed on the internal and extenal sides thereof. Examples Nos. 7 and 8 are slabs with an overlying layer formed on the top side thereof. Examples Nos. 9 and 10 are slabs with an overlying layer formed on both sides thereof. Example No. 11 is a round bar with an overlying layer formed therearound. Example 12 is a hollow billets with an overlying layer formed on the external side thereof. All products according to this invention were prepared by cold bonding a powder of a dissimilar cladding metal to the surface of a base metal. Then only the surface and a subsurface area of the layer of the dissimilar metal powder were melted and solidified in a vacuum. The solidified layer was then formed into an overlying layer by hot isostatic pressing. FIGS. 3 to 7 show the cross-sections of the individual products mentioned above. FIG. 3 shows a hollow billet 5 with an overlying layer 6 formed on the internal side thereof. FIG. 4 shows a hollow billet 5 with an overlying layer 6 formed on the internal and external sides thereof. FIG. 5 shows a slab with an overlying layer 6 formed on the top side thereof. FIG. 6 shows a slab 7 with an overlying layer 6 formed on the top and bottom sides thereof. FIG. 7 shows a round bar (a solid billet) 8 with an overlying layer 6 formed around the surface thereof.

On the other hand, Examples Nos. 13 and 14 for comparison were prepared by cold bonding and hot isostatic pressing, without melting and solidifying, a powder of an alloy to the inside of hollow billets. Examples Nos. 15 and 16 for comparison were made by hot working a billet and a slab prepared by putting together pipes and sheets of dissimilar metals according to conventional methods. The billet and slab were hot extruded and hot rolled, respectively.

Table 2 shows the clad metals made by hot working the semi-finished products described above under the conditions shown together. Table 2 also shows the results of tests conducted on satisfactorily hot worked products. Bending and ultrasonic flaw detection tests were performed according to JIS G 0601 and JIS Z 3124. A circle in Table 2 shows that no cracking and peeling occurred as a result of bending.

As shown in Table 2, fine cracks occurred in the cladding layer of Examples Nos. 13 and 14 for comparison. In Examples Nos. 15 and 16 for comparison, the base metal and cladding metal were neither uniformly worked nor bonded together.

In contrast, Examples Nos. 1 to 12 prepared by the methods of this invention proved to have excellent bending porperties. Under ultrasonic flaw detection test, they exhibited no unbonded area and other defects. Microscopic observation of the cross section of the hot worked products showed pore-free cladding layers and uniform satisfactory bonded interfaces.

TABLE 1-1

| No. | Base Metal: JIS Specification | Base Metal: Thickness or Diameter (mm) | Cladding Metal Layer: Material | Cladding Metal Layer: Main Components (% by weight) | Cladding Metal Layer: Thickness (mm) |
|---|---|---|---|---|---|
| Examples of This Invention | | | | | |
| 1 | SCM440 | Outside diameter: 170<br>Inside diameter: 78 | Cobalt-base alloy | 29Cr—7Mo—3Ni—0.28C—Co(the rest) | 5 |
| 2 | SNCM420H | Outside diameter: 170<br>Inside diameter: 78 | Nickel-base alloy | 16Cr—16Mo—5Fe—4W—2Co—Ni(the rest) | 5 |
| 3 | SCM430 | Outside diameter: 170<br>Inside diameter: 78 | " | 21Cr—9Mo—3.5Nb—3Fe—Ni(the rest) | 5 |
| 4 | SUS321 | Outside diameter: 160<br>Inside diameter: 78 | " | 16Cr—16Mo—5Fe—4W—2Co—Ni(the rest) | Inside: 5<br>Outside: 5 |
| 5 | STBA24 | Outside diameter: 160<br>Inside diameter: 78 | Inside: SUS310S<br>Outside: Nickel-base alloy | 25Cr—20Ni—Fe(the rest)<br>30Cr—20Fe—Ni(the rest) | Inside: 5<br>Outside: 5 |
| 6 | SUS316L | Outside diameter: 160<br>Inside diameter: 78 | Inside: Cobalt-base alloy<br>Outside: Nickel-base alloy | 35Ni—35Co—20Cr—10Mo<br>22Cr—6Mo—19Fe—2Cu—2Nb—Ni(the rest) | Inside: 5<br>Outside: 5 |
| 7 | SM50 | 100 t | Nickel-base alloy | 80Ni—20Cu | 10 |
| 8 | SUS304 | " | Cobalt-base alloy | 28Cr—6Mo—2.5Ni—0.25C—Co(the rest) | 10 |
| 9 | SNCM439 | 200 t | Nickel-base alloy | 25Cr—15Mo—10Fe—Ni(the rest) | 10 each |
| 10 | SPV50 | " | " | 16Cr—16Mo—5Fe—4W—2Co—Ni(the rest) | 10 each |
| 11 | S45C | Outside diameter: 170 | " | 21Cr—9Mo—3.5Nb—3Fe—Ni(the rest) | 5 |
| 12 | STBA24 | " | " | 30Cr—20Fe—Ni(the rest) | 5 |
| Conventional Products for Comparison | | | | | |
| 13 | SCM440 | Outside diameter: 170<br>Inside diameter: 78 | Nickel-base alloy | 16Cr—16Mo—5Fe—4W—2Co—Ni(the rest) | 5 |
| 14 | SNCM420 | Outside diameter: 170<br>Inside diameter: 78 | " | 30Mo—70Ni | 5 |
| 15 | SB49 | Outside diameter: 170<br>Inside diameter: 78 | " | 21Cr—9Mo—3.5Nb—3Fe—Ni(the rest) | 5 |
| 16 | SM41 | 100 t | " | 16Cr—16Mo—5Fe—4W—2Co—Ni(the rest) | 10 |

TABLE 1-2

| No. | Clad Surface | Cold Forming of Powder Layer | Porosity of Powder Layer (%) | Powder Layer Melting Conditions: Melting Means | Melting Depth (mm) | Vacuum (Torr) | Hot Isostatic Pressing Conditions: Temperature (°C.) | Pressure (kg/cm$^2$) | Time (h.) |
|---|---|---|---|---|---|---|---|---|---|
| Examples of This Invention | | | | | | | | | |
| 1 | Internal side of follow round billet | Cold isostatic pressing | 20 | Electron beam | 1.0 | $3 \times 10^{-5}$ | 1140 | 1900 | |
| 2 | Internal side of follow round billet | Cold isostatic pressing | 17 | Carbon dioxide gas laser | 0.6 | $4 \times 10^{-4}$ | 1150 | 1200 | 2 |
| 3 | Internal side of follow round billet | Cold isostatic pressing | 23 | Electron beam | 1.8 | $4 \times 10^{-5}$ | 1170 | 800 | 5 |
| 4 | Internal and external sides of hollow round billet | Cold isostatic pressing | 15 | " | 1.2 | $1 \times 10^{-5}$ | 1160 | 1500 | 4 |
| 5 | Internal and external sides of hollow round billet | Cold isostatic pressing | 22 | " | Inside: 0.8<br>Outside: 1.0 | $4 \times 10^{-5}$ | 1150 | 1500 | 4 |
| 6 | Internal and external sides of hollow round billet | Cold isostatic pressing | 20 | Carbon dioxide gas laser | Inside: 0.5<br>Outside: 0.5 | $4 \times 10^{-4}$ | 1140 | 1400 | 7 |
| 7 | Top side of Slab | Cold isostatic pressing | 12 | YAG laser | 0.5 | $3 \times 10^{-4}$ | 1100 | 1900 | 5 |
| 8 | " | Cold isostatic pressing | 19 | Electron beam | 3.0 | $2 \times 10^{-5}$ | 1130 | 1000 | 3 |
| 9 | Top and bottom sides of slab | Cold isostatic pressing | 22 | " | 4.0 | $2 \times 10^{-5}$ | 1170 | 800 | 5 |
| 10 | Top and bottom sides of slab | Cold isostatic pressing | 10 | " | 3.0 | $1 \times 10^{-5}$ | 1150 | 1200 | 2 |
| 11 | External side of solid billet | Cold pressing | 28 | " | 1.2 | $5 \times 10^{-4}$ | 1160 | 1400 | 4 |
| 12 | External side of hollow billet | Cold isostatic pressing | 15 | Plasma melting | 2.0 | $5 \times 10^{-4}$ | 1150 | 1800 | 3 |
| Conventional Products for Comparison | | | | | | | | | |
| 13 | External side of hollow round billet | Cold isostatic pressing | 25 | None | — | — | 1170 | 1700 | 5 |

TABLE 1-2-continued

| No. | Clad Surface | Cold Forming of Powder Layer | Porosity of Powder Layer (%) | Powder Layer Melting Conditions | | | Hot Isostatic Pressing Conditions | | |
|---|---|---|---|---|---|---|---|---|---|
| | | | | Melting Means | Melting Depth (mm) | Vacuum (Torr) | Temperature (°C.) | Pressure (kg/cm²) | Time (h.) |
| 14 | External side of hollow round billet | Cold isostatic pressing | 23 | None | — | — | 1150 | 1500 | 4 |
| 15 | External side of hollow round billet | — | — | — | — | — | Assembled billet (Note 1) | | |
| 16 | Top side of slab | — | — | — | — | — | Assembled slab (Note 2) | | |

Note 1: A billet made by fitting a tube of a nickel-base alloy over a tube of a base metal, with both ends thereof fixed together and the clearance therebetween evacuated to a vacuum.
Note 2: A slab made by fitting a sheet of a nickel-base alloy over a sheet of a base metal, with four sides thereof welded together and the clearance therebetween evacuated to a vacuum.

TABLE 2

| No. | Hot Working | Heating Temperature (°C.) | Product Size: Base Metal Thickness or Diameter (mm) | Product Size: Cladding Thickness (mm) | Results of Tests: Bending Test | Results of Tests: Ultrasonic Flaw Detection Test |
|---|---|---|---|---|---|---|
| Examples of This Invention | | | | | | |
| 1 | Hot extrusion | 1150 | Outside diameter: 73.0<br>Inside diameter: 62.7 | 0.35 | O | Flaw ratio: 0% |
| 2 | " | 1140 | Outside diameter: 73.0<br>Inside diameter: 62.7 | " | O | " |
| 3 | " | 1160 | Outside diameter: 73.0<br>Inside diameter: 62.7 | " | O | " |
| 4 | " | 1160 | Oustide diameter: 71.6<br>Inside diameter: 62.7 | External side: 0.7<br>Internal side: 0.35 | O | " |
| 5 | " | 1150 | Outside diameter: 71.6<br>Inside diameter: 62.7 | External side: 0.7<br>Internal side: 0.35 | O | " |
| 6 | " | 1140 | Outside diameter: 71.6<br>Inside diameter: 62.7 | External side: 0.7<br>Internal side: 0.35 | O | " |
| 7 | Hot rolling | 1080 | 12 t | 1.2 | O | " |
| 8 | " | 1140 | 15 t | 1.5 | O | " |
| 9 | " | 1150 | 10 t | 0.5 each | O | " |
| 10 | " | 1150 | 20 t | 1.0 each | O | " |
| 11 | " | 1130 | Outside diameter: 73.0 | 0.35 | O | " |
| 12 | Hot extrusion | 1150 | " | External side: 0.7 | O | " |
| Conventional Products for Comparison | | | | | | |
| 13 | Hot extrusion | 1150 | Cladding layer cracked when hot extruded | | — | — |
| 14 | " | 1160 | " | | — | — |
| 15 | " | 1170 | Tubes of base metal and nickel-base alloy remained unfixed | | — | — |
| 16 | Hot rolling | 1170 | Plates of base metal and nickel-base alloy remained unfixed | | — | — |

What is claimed is:

1. A method of producing a clad metal comprising the steps of:

forming a layer of a dissimilar metal powder on the surface of a base metal by cold fixing the powder to the surface under pressure;

densing only the surface and a subsurface area of the layer of the dissimilar metal powder by melting and immediately solidifying in a vacuum;

compressing the layer of the dissimilar metal powder together with the base metal at a temperature not higher than the solidus-line temperature of the two dissimilar metals under a pressure of not lower than 300 kgf/cm² using a hot isostatic press; and hot working the layer of the dissimilar metal together with the base metal.

2. A method of producing a clad metal according to claim 1, in which the surface and a subsurface area of a layer of as dissimilar metal powder is melted and immediately solidified by means of an electron beam.

3. A method of producing a clad metal according to claim 1, in which the surface and a subsurface area of a layer of a dissimilar metal powder is melted and immediately solidified by means of a high-power laser.

4. A method of producing a clad metal according to claim 1, in which the surface and a subsurface area of a layer of a dissimilar metal powder is melted and immediately solidified by means of plasma melting.

5. A method of producing a clad metal according to claim 1, 2, 3 or 4, in which the surface and a subsurface area of a layer of a dissimilar metal powder is melted to a depth of not less than 0.3 mm and not more than 5 mm.

6. A method of producing a clad metal according to claim 1, 2, 3 or 4, in which a powder of a dissimilar metal powder is cold bonded to the surface of a base metal by means of cold pressing.

7. A method of producing a clad metal according to claim 1, 2, 3 or 4, in which a powder of a dissimilar metal powder is cold bonded to the surface of a base metal by means of cold hydrostatic pressing.

8. A method of producing a clad metal according to claim 1, 2, 3 or 4, in which the layer of a dissimilar metal powder cold bonded on the surface of a base metal has a porosity of not higher than 30 percent.

9. A method of producing a clad metal according to claim 1, 2, 3 or 4, in which the surface and a subsurface area of the layer of a dissimilar metal powder is melted and immediately solidified in an atmosphere whose pressure is not higher than $1\times10^{-3}$ torr.

* * * * *